US005615858A

United States Patent [19]

Sferruzza, Jr.

[11] Patent Number: 5,615,858

[45] Date of Patent: Apr. 1, 1997

[54] HOLDER FOR SHAVER

[76] Inventor: Gerald A. Sferruzza, Jr., 1150 Cherry St., B.V.S., Lakeville, Mass. 02717

[21] Appl. No.: 233,386

[22] Filed: Apr. 26, 1994

[51] Int. Cl.[6] ..... F16M 13/00

[52] U.S. Cl. ..... 248/682; 248/314; 206/208

[58] Field of Search ..... 248/200, 309.1, 248/314, 682; 211/88; 206/228, 208, 244, 823, 349

[56] References Cited

U.S. PATENT DOCUMENTS

| | | | |
|---|---|---|---|
| D. 74,944 | 4/1928 | Peirce | 211/88 X |
| 2,243,433 | 5/1941 | McIntyre | 206/244 X |
| 2,304,307 | 12/1942 | Hollis | 206/228 |
| 2,443,495 | 6/1948 | De Tuesta | 206/208 |
| 2,845,245 | 7/1958 | Gray | 248/314 |
| 3,945,499 | 3/1976 | Brownson | 248/309.1 X |

FOREIGN PATENT DOCUMENTS

| | | | |
|---|---|---|---|
| 331076 | 12/1920 | Germany | 248/314 |

*Primary Examiner*—Alvin C. Chin-Shue
*Attorney, Agent, or Firm*—Steven N. Fox, Esq.

[57] ABSTRACT

This is a wall holder for an arced and handled shaving device. The holder includes an arced holding portion.

2 Claims, 2 Drawing Sheets

HOLDER FOR SHAVER

BACKGROUND OF THE INVENTION

Field of the Invention

This invention relates to a holder for shaving devices and more specifically to a holder for shaving devices having an arced head.

SUMMARY OF THE INVENTION

The invention disclosed herein is directed at a holder for shaving devices having an arced head. It is particulary designed for holding shaving devices such as described in U.S. Pat. No. 5,208,982.

BRIEF DESCRIPTION OF THE DRAWINGS

Further details are explained below with the help of the example(s) illustrated in the attached drawings in which.

DESCRIPTION OF THE PREFERRED EMBODIMENT(S)

Figure 1:
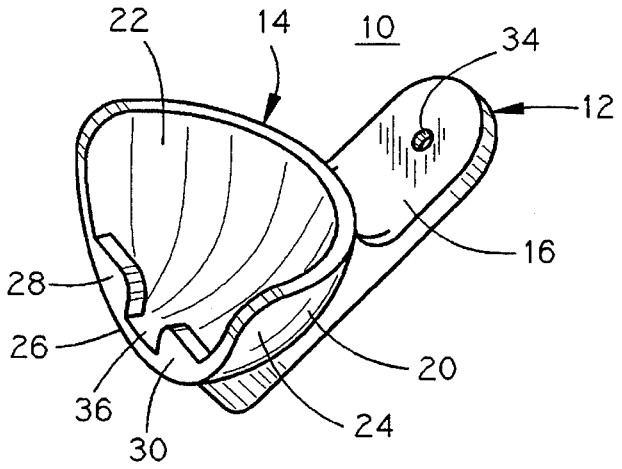
FIG. 1 is a perspective view of the holder for shaving devices, according to the present invention.
Figure 2:
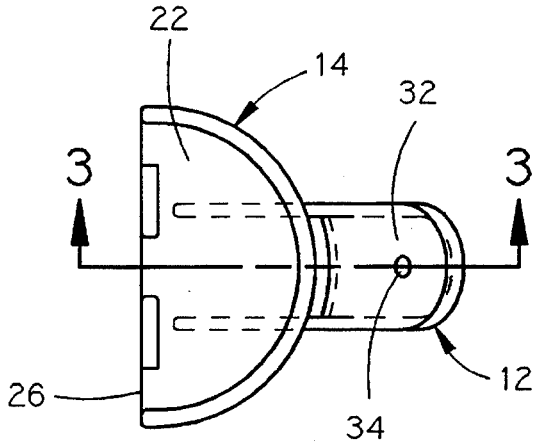
FIG. 2 is top plan view of the holder for shaving devices, shown in FIG. 1.
Figure 4:
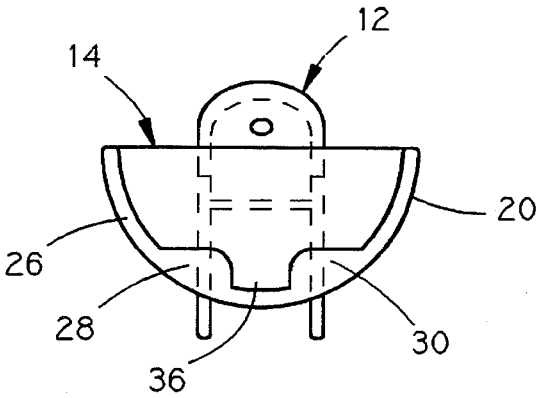
FIG. 4 is a front elevational view of the holder for shaving devices, shown in FIG. 1.
Figure 3:
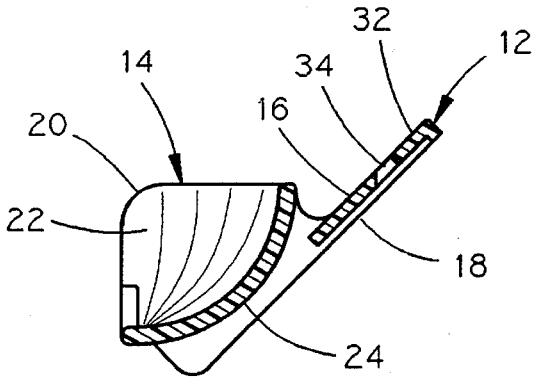
FIG. 3 is a sectional view of the holder for shaving devices, taken on line 2—2 of FIG. 2.
Figure 5:
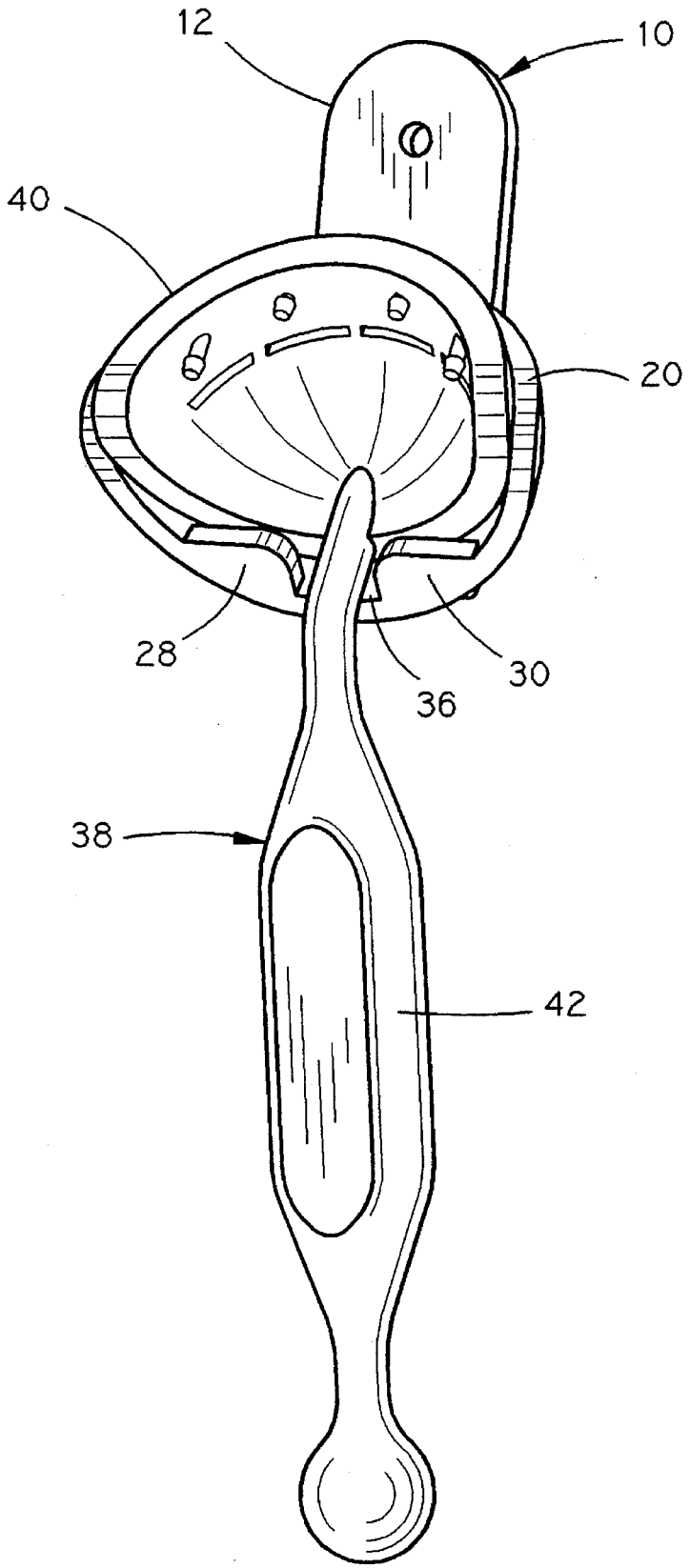
FIG. 5 is a perspective view of the holder for shaving devices, shown in FIG. 1, engaged to a shaving device.

There is shown in the drawings a holder 10 for a shaving device comprising a base 12 and a holding portion 14. The base 12 includes a top surface 16 and a bottom surface 18. The holding portion 14 including a cup shaped body portion 20 having an upper surface 22, a lower surface 24 and a forward edge 26. The holding portion 14 is integral with the base 12 and extends therefrom. The holding portion 14 has the configuration of one quarter of a sphere. A first stay portion 28 is attached to the forward edge 26. A second stay portion 30 is also attached to the forward edge 26 spaced from the first stay portion 28. The stay portions 28, 30 have the configuration of one quarter of a circle. The base 12 is generally rectangular in shape having a tab 32 through which an aperture 34 may be formed to proved a place for a string or the like from which the holder 10 may be hung for storage. The space defined by the spacing of the stay portions 28, 30 defines a slot 36. The bottom surface 18 may have an attachment means engaged therewith, an adhesive for example for adherance to a wall.

With the holder 10 attached to a support, a wall, for example, it may be used to hold a shaver 38. The shaver 38 comprises an arcuate head 40 having a handle 42 integral therewith and extend therefrom. The arcuate head 40 is positioned in abutting relation with the upper surface of the cup shaped body portion 20 of the holding portion with the handle 42 extending through the slot 36.

What I claim is:

1. A holder for a razor, the razor having a handle, the holder comprising a base portion and a holding portion, said base portion having an upper surface and a lower surface, said holding portion integral with said base portion and extending therefrom, said holding portion having the configuration of one quarter of a sphere having an outer convex surface and an inner concave surface, said one quarter sphere being cup like and facing away from said base portion, said convex surface being attached to said upper surface, and said one quarter sphere includes a continuous rear edge and a continuous forward edge, said continuous forward edge having a first barrier portion and a second barrier portion attached thereto and spaced from each other, whereby the razor and the handle may be held in said holding portion.

2. A holder for a razor as set forth in claim 1 wherein said base portion includes an attachment means whereby said holder may be attached to a support.

* * * * *